United States Patent [19]

Lyons, Sr.

[11] Patent Number: 4,873,791

[45] Date of Patent: Oct. 17, 1989

[54] TORQUE ROD OPERATED COUNTERBALANCING HINGE AND DOOR ASSEMBLY

[75] Inventor: Robert Lyons, Sr., Hamden, Conn.

[73] Assignee: The Bilco Company, West Haven, Conn.

[21] Appl. No.: 263,533

[22] Filed: Oct. 27, 1988

[51] Int. Cl.[4] ..... E05F 1/10

[52] U.S. Cl. ..... 49/386; 16/308

[58] Field of Search ..... 49/379, 386; 267/57; 16/308, 303

[56] References Cited

U.S. PATENT DOCUMENTS

| | | | |
|---|---|---|---|
| Re. 32,878 | 2/1989 | Leonard | 16/308 |
| 3,061,871 | 11/1962 | Swanson . | |
| 3,067,453 | 12/1962 | Lyons | 16/308 |
| 3,085,286 | 4/1963 | Whitehouse | 16/308 |
| 3,339,969 | 9/1967 | Bridle et al. . | |
| 3,476,375 | 11/1969 | Brasseur | 16/308 |
| 3,490,756 | 1/1970 | Spier . | |
| 3,896,595 | 7/1975 | Anghinetti et al. . | |
| 4,163,344 | 8/1979 | Scherer . | |
| 4,402,111 | 9/1983 | Selby et al. . | |
| 4,580,315 | 4/1986 | Beckwith | 16/308 |

OTHER PUBLICATIONS

Product Design and Development Airport Counterbalance Advertisement, Jan., 1987.

Bilco Installation Instructions (copyright 1984) p. 3.

*Primary Examiner*—Kenneth J. Dorner

*Assistant Examiner*—Gerald A. Anderson

*Attorney, Agent, or Firm*—Delio & Associates

[57] ABSTRACT

A torque rod operated counterbalancing hinge comprising first and second hinge members connected together at a hinge point, the second hinge member being curved with a cam surface to the first hinge member, and the other end rotatable relative to a pivot point located at a position displaced from the location of the hinge point. A lever arm has one end rotatably mounted at the pivot point and the other end has a bearing surface for contacting the cam surface. The rotating end of the torque rod is fixed relative to the lever arm whereby rotational hinge motion of the first hinge member relative to the second hinge member causes the cam surface to press upon the bearing surface through a moving contact point which rotates the lever arm to produce a counterbalancing twisting of the torque rod. The invention also includes a door assembly employing the counterbalancing hinges.

19 Claims, 2 Drawing Sheets

TORQUE ROD OPERATED COUNTERBALANCING HINGE AND DOOR ASSEMBLY

BACKGROUND OF THE INVENTION

1. Field of the Invention

This invention relates to counterbalancing hinges and door assemblies employing such hinges, and in particular to torque rod operated hinges which counterbalance non-vertically hinged doors which must be lifted against the force of gravity.

2. Description of Related Art

There are numerous applications in which the hinge line for a door or other object is non-vertical. Such applications include, among others, hatch covers for roof openings, flush-mounted sidewalk doors, and, as illustrated here, the entrance doors for exterior basement entrances. Because the hinge line is at least partially horizontal in such applications, the weight of the door must be supported until the center of mass of the door is raised over the hinge line.

Doors of the type described are often quite heavy, and can be dangerous due to their tendency to close rapidly and with great force when released Accordingly, it has long been the practice to counterbalance the doors, not only for increased safety, but also to permit the door to be opened and closed more easily with less force.

Typically, the required counterbalancing torque has been derived from torque rods, springs or gas cylinders. Torque rods have the particular advantage that they provide their counterbalancing torque as a result of the rotation of one end of the rod relative to the other. Thus, prior art counterbalancing hinges employing torque rods simply connected one end of the torque rod to one leaf of the hinge (or directly to the door) and the other end to the other leaf of the hinge (or the door frame). Through appropriate selection of the torque rod dimensions this provided a simple means for partial counterbalancing of the door. Torque rods also have the advantages that their long thin shape can be positioned out of the way behind the door frame, and they are extremely rugged and reliable, an important consideration in doors which are often used for exterior access.

However, a torque rod (like springs and gas cylinders) provides a counterbalancing torque which is linearly proportional to the input. In the case of a torque rod, that input is the amount of the rotation or "twist" applied to it. This linear relationship means that, doubling the amount of twist applied to the torque rod doubles the counterbalancing torque it provides. Unfortunately, a non-vertically hinged door requires a counterbalancing torque which is not a linear function of the opening angle of the door, but is a sinusoidal function (sine or cosine or a shifted version thereof depending on how the opening angle is measured).

As a result, a prior art counterbalancing hinge using torque rods could only provide exact counterbalance for the door at two different opening angles, i.e., where the linear graph of applied torque (measured at the hinge line) intersects the sinusoidally curved graph of the required counterbalance torque. While these two points (which correspond to specific opening angles for the door) are under the hinge designer's control, they have usually been selected to be at approximately the fully-opened and fully-closed positions. Except at these two angles, the door is either under- or over-balanced and will move if released. Thus the counterbalancing problem is only partially solved in prior art torque rod operated counterbalancing hinges.

Bearing in mind these and other deficiencies of the prior art, it is therefore an object of the present invention to provide a new and improved torque rod operated counterbalancing hinge and door assembly which substantially completely counterbalances the door. An other object of the invention is to provide a counterbalancing hinge with a reduced number of components thereby reducing the cost and permitting faster and easier assembly.

SUMMARY OF THE INVENTION

The above objects, and other objects which will be apparent to those skilled in the art, are achieved in the present invention which provides a counterbalancing hinge comprising first and second hinge members connected together at a hinge point, the second hinge member being curved with a cam surface formed thereon. The counterbalancing hinge uses a torque rod having one of its ends fixed relative to the first hinge member, and the other end rotatable relative to a pivot point located at a position displaced from the location of the hinge point.

A lever arm has one end rotatably mounted at the pivot point and the other end has a bearing surface for contacting the cam surface. The rotating end of the torque rod is fixed relative to the lever arm whereby rotational hinge motion of the first hinge member relative to the second hinge member causes the cam surface to press upon the bearing surface through a moving contact point which rotates the lever arm to produce a counterbalancing twisting of the torque rod.

In the preferred embodiment, the rotating end of the torque rod is curved into a "U"-shape, with one of the legs of the "U" being rotationally mounted at the pivot point on the first hinge member at a location displaced from the location of the hinge point. A bearing member is mounted on the rotating end of the torque rod in contact with the other leg of the U-shape. The "U"-shape forms a lever arm through which the force of the torque rod is applied to the bearing member and the cam surface to provide the opening torque.

The invention also includes a door assembly employing the counterbalancing hinges.

DETAILED DESCRIPTION OF THE INVENTION

Figure 1:
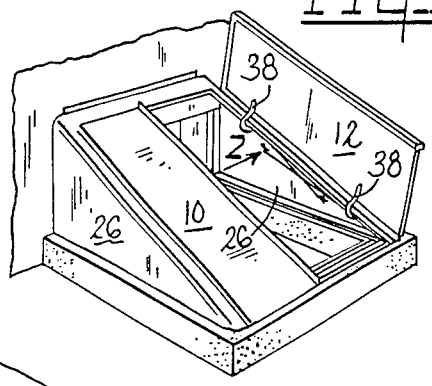
FIG. 1 is a perspective view of a basement entrance having two basement doors, each door being hinged with two counterbalancing hinges according to the present invention.

FIG. 1 shows a perspective view of a basement entrance commonly found on a home for providing exterior access to the basement. Entrance is provided by two side-by-side steel doors (10, 12) which cover the door opening and which must be lifted to provide access. A stairway (not seen in the figures) is mounted below grade to permit access to and from the basement.

As can be seen, the hinge line for the doors is non-vertical. Whenever one of the doors is opened or closed its weight must be supported against the force of gravity until the door is either fully-open, with its center of mass over the hinge line or fully-closed with its weight resting on the door frame.

As is well known, the force required to support a horizontally hinged door is dependent upon the opening angle of the door. With the door fully closed, which will be referred to herein as having an opening angle of zero degrees, almost the entire weight of the door must initially be lifted against the force of gravity. However as the door swings up, the hinges increasingly begin to support the weight of the door until the opening angle has reached 90 degrees at which point the center of mass of the door is over the hinge line and the door is fully open. Mathematically, the exact force required to support the door at each angle is a sinusoidal function of the angle of the door.

Where the opening angle is as defined above, the torque at the hinge line required to support the door against the force of gravity is proportional to the cosine of the opening angle times the weight of the door times the distance from the center of mass of the door to the hinge line.

For doors having a hinge line which is not perfectly horizontal which is the case shown in FIG. 1, the doors are already partially supported by the hinges even when fully closed. Thus, the magnitude of the required counterbalancing torque is somewhat less than for a perfectly horizontal hinge line. The exact magnitude of the required torque is dependent upon the weight of the door, the location of its center of mass, and the angle of inclination of the door's hinge line relative to the horizontal.

Although the required counterbalance torque has long been known, the available devices for counterbalancing, including principally, torque rods, springs and gas cylinders all provide a force output which is a linear function of the input.

Figure 6:
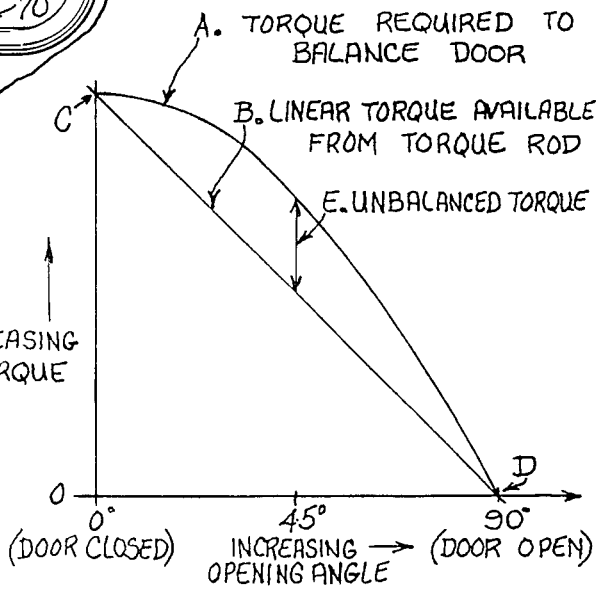
FIG. 6 is a graph showing the torque required to balance a horizontally hinged door and the linear balancing torque available from a torque rod.

FIG. 6 provides a graph showing torque at the hinge line as a function of opening angle. Curve A shows the torque required to balance a non-vertically hinged door against gravity. It is proportional to the cosine of the opening angle.

Curve B shows the linear torque which is directly available from a torque rod, such as is provided when the two ends of the rod are attached to the door and the door frame respectively. In such a case, the opening angle of the door is the same as the angle of twist applied to the torque rod. Curve B has been drawn to represent the typical configuration wherein the door is exactly balanced by the torque rod when the door is fully closed (point C). At point D, with the door fully open, the torque rod provides no counterbalancing torque, but all the weight is over the hinge line and the door is again in balance. However, as can be seen at E, when the door is opened to any angle between fully opened and fully closed, there is a substantial mismatch between the linear balancing torque available from the directly connected torque rod (curve B) and the torque required to actually fully balance the door (curve A).

As shown by the difference between curves A and B, in a prior art door assembly, the door is perfectly balanced when closed. However, as the door is lifted, it immediately becomes unbalanced and the door becomes progressively heavier up to a maximum at which point the forces begin to decrease until balance is achieved again with the door perfectly vertical.

As a result, the door will remain motionless when it is released only at the fully closed (point C) and fully opened (point D) positions. If the door is released at any other point, its unsupported weight causes it to accelerate towards the closed position, occasionally with damaging consequences.

The present invention provides a counterbalancing hinge which unlike prior art torque rod hinges described above has a simple mechanical arrangement which modifies the linear torque rod output to produce a counterbalancing torque which perfectly counterbalances the door. This output modification is accomplished through a cam and bearing arrangement whose function is advantageously combined within the hinge elements to simplify construction and assembly and to reduce the number of components required.

The result is that the door can be released at an opening angle and will remain at that angle without moving. The door can be easily moved from one position to another with only the lightest of forces, and there is no risk that the door will close unexpectedly.

Figure 2:
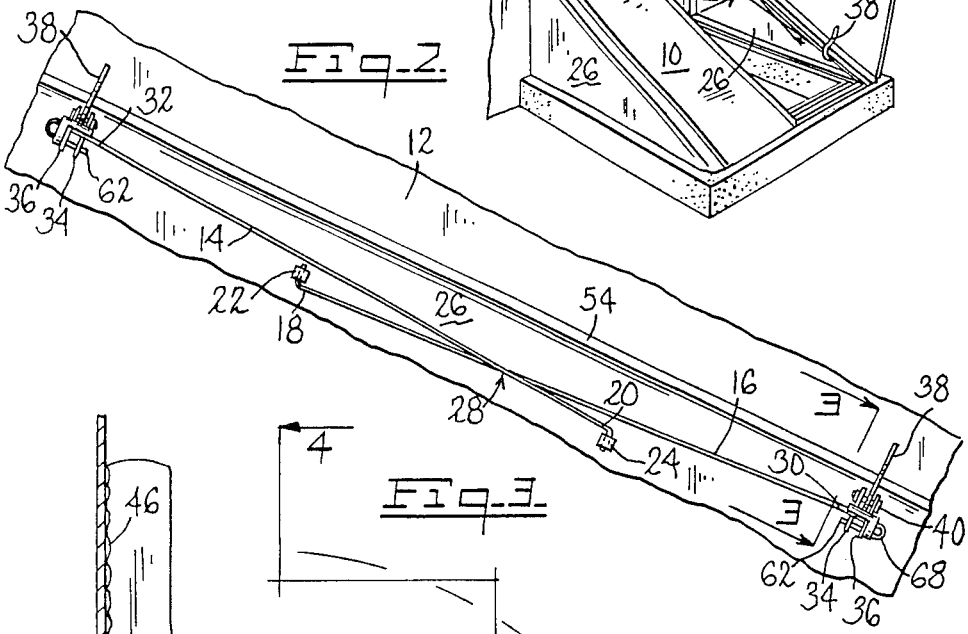
FIG. 2 is a partial view of the basement entrance in FIG. 1 showing two counterbalancing hinges viewed from the direction marked 2 in FIG. 1.

Referring now to FIGS. 1 and 2, the doors 10, 12 are each supported by two counterbalancing hinges according to the present invention. Each hinge includes a counter balance torque means for producing a counterbalancing torque at a hinge point which is a substantially sinusoidal function of the opening angle of the hinge. The counterbalance torque means includes a lever arm means, and a linear force producing means. The two hinges are substantially identical except that the linear force producing means, which are preferably torque rods have been bent into left hand 14 and right hand 16 configurations respectively.

Each torque rod 14, 16 has its respective fixed end 18, 20 bent at right angles to the body of the torque rod and inserted into a retainer 22, 24 mounted on the door frame 26.

The retainers 22, 24 have a winged U-shape cross section, the wings being spot welded or otherwise securely attached to the door frame 26. The U-shape portion of each retainer provides just enough clearance for the right angle portion of the fixed ends 18, 20 to be inserted therein, thus trapping the ends between the retainer and the door frame.

The fixed ends 18, 20 are prevented from escaping from the retainers during normal use of the doors by the manner in which the body of the two torque rods are crossed at point 28 and the opposite direction of insertion of the fixed ends 18, 20 into the retainers.

Specifically, the left torque rod 14 has its fixed end 20 bent downwardly and inserted into retainer 24 from the top. The right torque rod 16 crosses over the body of the left torque rod 14 at point 28 which exerts a downward force holding the fixed end 20 securely in the retainer 24. In contrast, the fixed end 18 of the right torque rod 16 is bent upwardly and is held within its retainer by the upward counteracting force of the left torque rod exerted at the crossing point 28.

Also seen in FIG. 2 are the rotating ends 30, 32 of the torque rods. As is described in detail below, the rotating ends are twisted as the door 12 is pivoted on its hinges, thereby providing the counterbalancing force for the door. The amount of twisting is controlled by a cam mechanism integrally incorporated within the hinge and the counterbalancing torque produced is sufficient to exactly counterbalance the weight of the door at each point as the door is moved from the fully open position (see door 12 in FIG. 1) to the fully closed position (see door 10 in FIG. 1).

Figure 3:
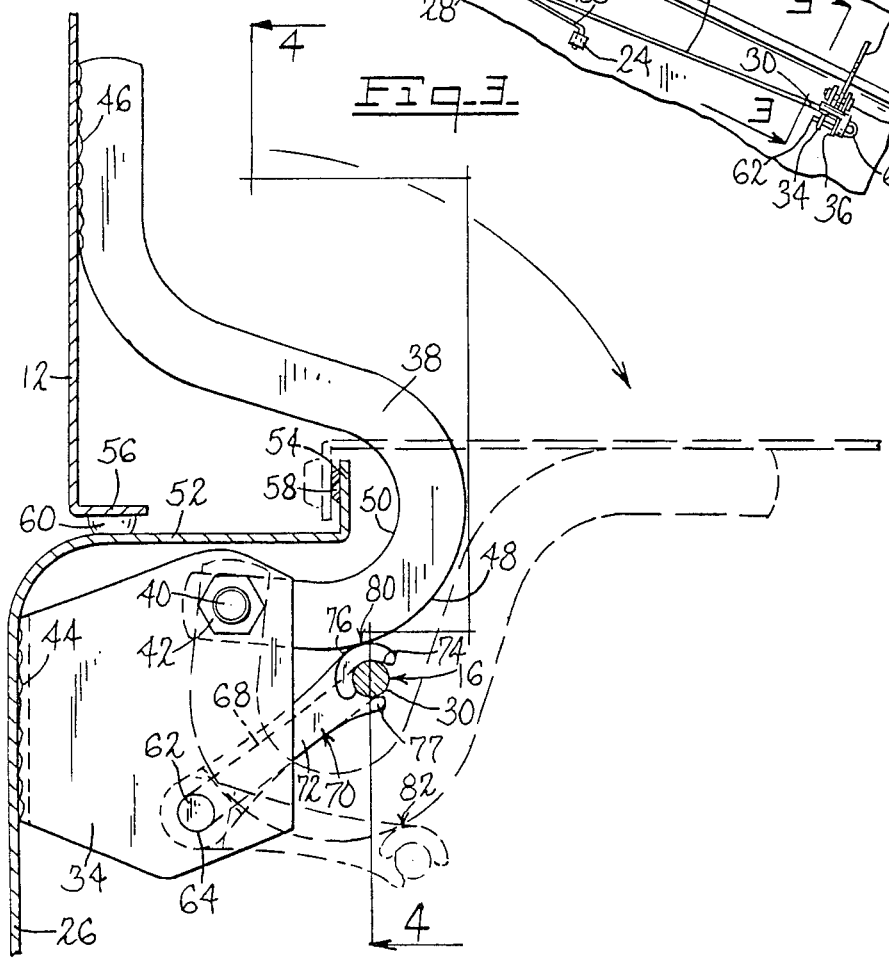
FIG. 3 is a side view of a counterbalancing hinge, partially in section, along line 3—3 of FIG. 2.
Figure 4:
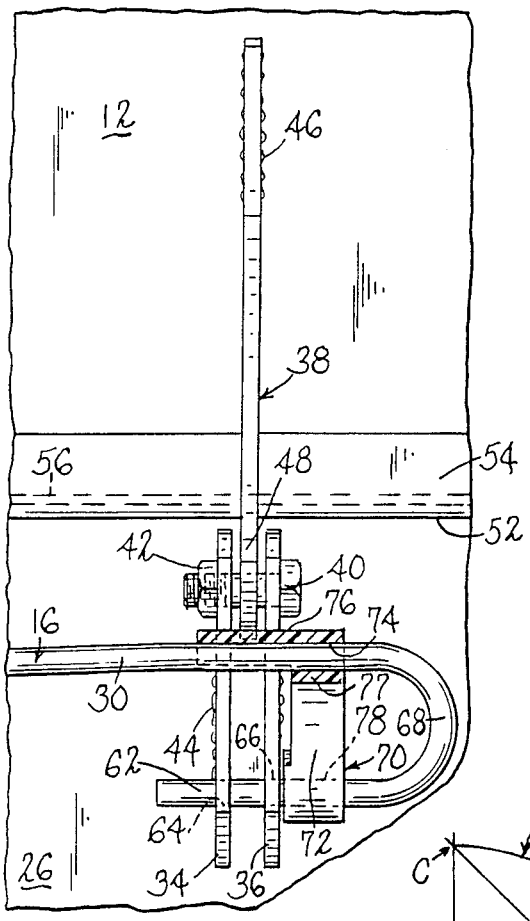
FIG. 4 is a front view of a counterbalancing hinge, also partially in section, along line 4—4 of FIG. 3.

FIGS. 3 & 4 show detailed views of the principal portions of the counterbalancing hinge according to the present invention. These views show the rightmost hinge. For convenience, only that hinge will be described in detail. The leftmost hinge is identical except for the direction of the right angle bends of the torque rods 14, 16 at their fixed ends as described above.

The counterbalancing hinge comprises a first hinge member formed from two spaced-apart plates 34, 36 (seen best in FIG. 4) and a second hinge member 38. The two hinge members are hingedly connected at a hinge point formed by hinge bolt 40 and nut 42.

The first hinge member is preferably formed from a single piece of sheet steel bent to form the two parallel spaced-apart plates 34, 36, thereby holding the plates 34,36 in correct alignment prior to assembly. The first hinge member is then welded at 44 or otherwise secured to the door frame 26. Similarly, the second hinge member 38, which is also preferably formed of steel, is welded at 46 to the door 12. Thus, the door 12 swings about the hinge point defined by hinge bolt 40 between the fully opened position as shown in solid lines in FIG. 3, and the fully closed position shown in dashed lines in FIG. 3.

As can be clearly seen in FIG. 3, the second hinge member is curved, preferably into the gooseneck curve shown. The exterior of the curve forms a cam means having a cam surface 48. This integration of the curved cam surface into the second hinge member reduces the total number of components, decreases the size of the hinge and speeds construction of the hinge and door assembly, as a separate cam is not required.

In the preferred design employing a gooseneck curve, the interior of the curve 50 provides clearance for an overhanging portion 52 of the door frame 26. This design permits the hinge point and the first hinge member to be protectively located beneath the overhanging portion 52. The overhanging portion includes an upturned lip 54 which prevents rain, dirt, etc. from entering the door opening. A mating downturned edge 56 on door 12 is provided to further seal the door opening. The upturned lip 54 may optionally include a resilient seal 58 which seals against the downturned edge 56 when the door 12 is closed. The downturned edge 56 may also include an external bumper stop 60 to cushion the shock of the door when it reaches the fully opened position.

Figure 5:
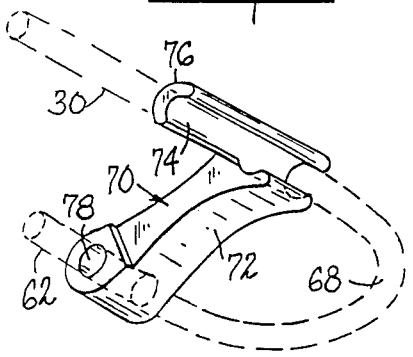
FIG. 5 is a detail view, in perspective, of the bearing member, with the "U"-shape rotating end of the torque rod being drawn in phantom.

As can be seen in FIGS. 2, 4 and 5, the end of torque rod 16 located at the hinge is bent into a "U"-shape. The rotating end 30 connects to one leg of the "U", and the other leg 62 is inserted through pivot holes 64, 66 in the spaced apart plates 34, 36 thereby forming a pivot point about which the torque rod 16 rotates. The entire "U"-shape, including the base of the "U" 68, forms a lever arm means, one end of which rotates around the pivot point 64, 66.

A bearing member 70, shown in perspective in FIG. 5, has a body portion 72 and bearing surface portion 74. The exterior of the bearing surface portion 74 forms a bearing surface 76. The bearing member is preferably a separate piece formed of a tough wear resistant bearing material such as the plastic material sold under the tradename "Delrin". Alternatively, the bearing member may be eliminated and the end of the torque rod may serve as the bearing surface.

A hole 78 is provided in the body of the bearing member. During assembly, leg 62 of the "U" is first slipped into hole 78 of the bearing member. Leg 62 is then inserted into the pivot holes 64, 66 in the first hinge member. The fixed end of the torque rod is then inserted into its retainer 22. When the corresponding operations are completed on the leftmost hinge seen in FIG. 2, the torque rods are securely retained in position without the necessity for any additional fasteners.

As can be seen in FIG. 4, the bearing member is also held in position without the necessity for fasteners (although, if desired, a simple slip nut may be used to hold the bearing member on the torque rod during shipment and prior to assembly). The "U"-shape bend in the torque rod prevents the bearing member from sliding in one direction and the first hinge member prevents it from moving in the other. The bearing surface 76 is held between the torque rod at one end of the lever arm and the cam surface 48 and is further prevented from lifting off the torque rod by the portion 77 of the bearing member.

In this preferred design, the torque rods have been configured to serve as their own lever arms and pivots which also minimizes the number of components required.

However, other designs, within the scope of the invention, may employ a separate lever arm to which the rotating end of the torque rod is connected. The torque rod may be connected either at the bearing end of the lever arm, as shown in the drawings, or at the pivoting end of the lever arm, or at any point in between as it is merely necessary for the torque rod to be twisted by the angle of rotation of the lever arm relative to the pivot point.

For example, the "U"-shape seen in FIG. 4 may be reversed, in which case the rotating end 30 of the torque rod would pass directly through the pivot holes 64, 66, and the other leg of the "U", at the tip of the torque rod, would serve as the bearing end. However, such a configuration has several disadvantages as compared to the design shown in the drawings. Initially, it will be seen that it would be more difficult to assemble because the tip of the torque rod could not be inserted through the pivot holes in the manner shown.

However, of more importance, is the fact that the present design stabilizes the lever arm. In order for the counterbalancing to occur correctly, the lever arm must remain relatively rigid. If it bends under load, it changes the magnitude and direction of the counterbalancing forces, thus upsetting the action of the cam and lever arm relationship which produces the proper counterbalancing. In the configuration shown above, the leg 62 at the tip of the torque rod is prevented from bending significantly by the two parallel spaced-apart plates 34, 36 and the holes therein 64, 66 which hold that end of the torque rod in axial alignment with the desired pivot point. On the other leg of the "U", the stiffness of the body of the torque rod provides counteraction to the forces trying to bend this portion of the lever arm out of alignment.

Referring now to FIG. 3, the operation of the counterbalancing hinge will be described in detail. With the door in the fully opened position as shown in the solid lines of FIG. 3, the center of mass of the door is just slightly behind the hinge point 40. Thus, there is a slight tendency for the door to remain in the open position and the door sits upon bumper 60.

In this position, the torque rod 16 is in its untwisted configuration which is such that it holds the bearing surface 76 lightly against the cam surface 48 at contact point 80. As the door 12 is moved towards the closed position, the second hinge member 38 rotates about the hinge point and forces the cam surface 48 against the bearing surface. As this happens, the contact point 80 begins to move along the cam surface and the torque rod and lever arm begin to rotate around the pivot point 64, 66 until door 12 has reached the fully closed position shown in dashed lines and the contact point has moved from point 80 to point 82.

It can be seen that the angle of rotation of the door about the hinge point is 90 degrees, however, due to the displacement between the hinge point and the pivot point, the angle of rotation of the lever arm, which represents the angle of twist of the torque rod is significantly less than 90 degrees.

At the same time, due to the moving contact point, point 82 is significantly farther from the hinge point than is point 80. As described below, this change in the position of the contact point, in combination with the shape of the cam surface which controls the direction in which the torque rod force is applied, produces the higher counterbalancing torque around the hinge point required to counterbalance the door in the position shown in dashed lines.

The counterbalancing torque at the hinge point is conventionally defined as being equal to the magnitude of the force at the contact point times the perpendicular distance from the hinge point to the line of force at the contact point.

The direction of the line of force at the contact point is determined by the shape of the cam surface 48, with the force always being exactly normal to that surface. The magnitude of the force at the contact point is equal to the torque provided by the torque rod at the pivot point divided by the perpendicular distance from the pivot point to the line of force at the contact point.

The magnitude of the torque provided by the torque rod is set by the well known formula:

$$T = K\frac{d^4\phi}{l}$$

where T is the torque produced, d is the torque rod diameter, $\phi$ is the angle of twist of the torque rod, l is the length of the torque rod and K is a constant dependent upon the units of measurement.

The modification of the linear output torque of the torque rod is produced by the cam design and the offset between the hinge point and the pivot point for the lever arm and torque rod. By locating the pivot point at a position displaced from the hinge point, the contact point between the bearing member and the cam surface moves relative to the hinge point and slides along the cam surface to control the counterbalancing.

Through appropriate choice of the shape of the cam, the torque rod diameter and the offset between the hinge point and the pivot point, doors and other objects of substantially any size or configuration can be almost perfectly balanced.

The balancing effect is achieved through the action of the torque rod bearing on the cam surface of the hinge in such a manner that the torque at the hinge point produced (as described above) is equal in magnitude at each degree of opening to the torque produced by the weight of the door times the perpendicular distance from the hinge point to the door's own line of force through its center of gravity.

Those familiar with cam systems will also understand that the shape of the cam surface may be slightly altered by forming detents, flat spots, bumps, etc. thereon which will cause the door to have certain preferred angles at which it will remain. This would, for example, permit the door to be opened to a first detent position in order to vent the basement and the door would resist small forces such as would be generated by wind pressure.

Similarly, the cam surface may be designed to slightly undercompensate the weight of the door just as it reaches the fully closed position to provide the feel of solid closure or to slightly overcompensate at the open position to exert an additional "hold-open" force.

Alternatively, the bearing surface may be altered slightly to produce these effects instead of the cam surface. As seen in FIG. 3, the contact point moves around the bearing surface from point 80 (when the door is open) to point 82 (when the door is closed). By producing a non-arcuate bearing surface, for example by producing flat spots, bumps, indentations, etc. on the bearing surface, the same effects as are described above can be achieved.

In view of the foregoing description it will be apparent that the invention is not limited to the specific details set forth therein for the purposes of illustration, and that various other modifications are equivalent for the stated and illustrated functions without departing from the spirit and scope of the invention.

What I claim is:

1. A counterbalancing hinge comprising:

a first hinge member;

a second hinge member connected to the first hinge member at a hinge point, the second hinge member being curved and having a cam surface formed thereon;

a torque rod having a fixed end which is fixed relative to the first hinge member and a rotating end which is rotatable relative to a pivot point located at a position displaced from the location of the hinge point;

a bearing surface for contacting the cam surface; and a lever arm having one end rotatably mounted at the pivot point and the other end having the bearing surface thereon, the rotating end of the torque rod being fixed relative to the lever arm;

whereby rotational hinge motion of the first hinge member relative to the second hinge member causes the cam surface to press upon the bearing surface through a moving contact point which rotates the lever arm to produce a counterbalancing twisting of the torque rod.

2. A counterbalancing hinge according to claim wherein the lever arm is integrally formed from the torque rod by bending.

3. A counterbalancing hinge according to claim 2 wherein the lever arm has a "U"-shape, one leg thereof having the bearing surface positioned thereon, and the other leg of the "U" being rotatably mounted at the pivot point.

4. A counterbalancing hinge according to claim 3 wherein the rotating end of the torque rod forms the leg of the "U" having the bearing surface positioned thereon.

5. A counterbalancing hinge according to claim 1 further including a bearing member having the bearing surface formed thereon, the bearing member being manufactured of a wear-resistant bearing material and being mounted on the lever arm.

6. A counterbalancing hinge according to claim 5 wherein the bearing surface on the bearing member has a non-arcuate cross-section.

7. A counterbalancing hinge according to claim 5 wherein the bearing member is one piece, comprising a body portion and a bearing surface portion, the bearing surface portion being held between the lever arm and the cam surface, the body portion having a hole therein through which the torque rod passes.

8. A counterbalancing hinge according to claim 1 wherein the second hinge member forms a gooseneck curve, the exterior of the gooseneck curve forming the cam surface and the interior of the gooseneck curve providing clearance such that the hinge point may be located beneath an overhanging door frame.

9. A counterbalancing hinge according to claim 8 wherein the pivot point is located below and behind the hinge point relative to the overhanging door frame.

10. A counterbalancing hinge according to claim wherein the first hinge member comprises two parallel spaced-apart plates, the second hinge member being pivotally mounted on a hinge pin perpendicularly supported between the plates.

11. A door assembly comprising:

a door;

a door frame; and at least two counterbalancing hinges mounted at spaced apart locations adjacent an edge of the door, the hinges comprising:

a first hinge member;

a second hinge member connected to the first hinge member at a hinge point, the second hinge member being curved and having a cam surface formed thereon;

a torque rod having a fixed end which is fixed relative to the first hinge member and a rotating end which is rotatable relative to a pivot point located at a position displaced from the location of the hinge point;

a bearing surface for contacting the cam surface; and a lever arm having one end rotatably mounted at the pivot point and the other end having the bearing surface thereon, the rotating end of the torque rod being fixed relative to the lever arm;

whereby rotational hinge motion of the first hinge member relative to the second hinge member causes the cam surface to press upon the bearing surface through a moving contact point which rotates the lever arm to produce a counterbalancing twisting of the torque rod.

12. A door assembly according to claim 11 including two counterbalancing hinges, the first hinge member from each hinge being mounted on the door frame, the torque rods from each hinge extending towards the other hinge and each having its fixed end mounted on the door frame.

13. A door assembly according to claim 12 wherein the torque rods cross one another, the fixed end of each torque rod being bent at a right angle and each being inserted in opposite directions into respective retainers mounted on the door frame, the direction of insertion acting with the crossing of the torque rods to prevent the fixed ends from escaping the retainers during normal use of the door assembly.

14. A door assembly according to claim 12 wherein the door frame includes an overhanging portion, the first hinge member of each hinge being mounted on the door frame, the hinge point of each hinge being located beneath the overhanging portion of the door frame, and the second hinge member of each hinge forming a gooseneck curve, the exterior of each gooseneck curve forming the cam surface and the interior of the gooseneck curve providing clearance for the overhanging portion of the door frame.

15. A door assembly according to claim 14 wherein the overhanging portion of the door frame includes an upturned lip along its edge, the interior of the gooseneck curve having clearance for the upturned lip, and an edge of the door having a mating downturned edge.

16. A basement door assembly according to claim 11 comprising two doors hinged to a door frame, each door being hinged with at least two counterbalancing hinges.

17. A counterbalancing hinge comprising:

a first hinge member;

a second hinge member hingedly connected to the first hinge member at a hinge point, said second hinge member integrally including a cam means having a cam surface formed thereon; and a counterbalance torque means for producing a counterbalancing torque at the hinge point which is a substantially sinusoidal function of the opening angle of the hinge, said counterbalance torque means including:

a lever arm means rotatably mounted at a pivot point, said pivot point being located at a position displaced from the location of the hinge point said lever arm means having a bearing surface for contacting the cam surface; and a linear force producing means operatively connected between the lever arm means and the first hinge member.

18. A counterbalancing hinge according to claim 17 wherein the linear force producing means is a torque rod.

19. A counterbalancing hinge according to claim 18 wherein the second hinge member forms a gooseneck curve, the exterior of the gooseneck curve forming the cam surface.

* * * * *

UNITED STATES PATENT AND TRADEMARK OFFICE

CERTIFICATE OF CORRECTION

PATENT NO. : 4,873,791

DATED : October 17, 1989

INVENTOR(S) : Robert Lyons, Sr.

It is certified that error appears in the above-identified patent and that said Letters Patent is hereby corrected as shown below:

Column 1, line 25, insert a period after "released".

Column 4, line 28, delete "an" and replace it with --any--.

Column 8, line 66 and column 9, line 33, change the claim dependencies to read --according to claim 1--.

Signed and Sealed this

Eighteenth Day of September, 1990

*Attest:*

HARRY F. MANBECK, JR.

*Attesting Officer*

*Commissioner of Patents and Trademarks*